US006948970B2

(12) United States Patent
Hayashi et al.

(10) Patent No.: US 6,948,970 B2
(45) Date of Patent: Sep. 27, 2005

(54) CONNECTOR HAVING AN ENGAGING MEMBER FOR HOLDING A CABLE

(75) Inventors: Yasufumi Hayashi, Tokyo (JP); Terumi Nakaya, Aomori (JP)

(73) Assignees: Japan Aviation Electronics Industry, Limited, Tokyo (JP); JAE Hirosaki, Ltd., Aomori (JP)

( * ) Notice: Subject to any disclaimer, the term of this patent is extended or adjusted under 35 U.S.C. 154(b) by 0 days.

(21) Appl. No.: 10/930,379

(22) Filed: Aug. 31, 2004

(65) Prior Publication Data

US 2005/0059292 A1 Mar. 17, 2005

(30) Foreign Application Priority Data

Sep. 5, 2003 (JP) ..... 2003-313692

(51) Int. Cl.[7] ..... H01R 13/58
(52) U.S. Cl. ..... 439/460; 439/457
(58) Field of Search ..... 439/459, 460, 439/457, 451, 462, 274, 587; 174/65 G

(56) References Cited

U.S. PATENT DOCUMENTS 4,386,817 A * 6/1983 Benker et al. ..... 439/460
4,640,568 A * 2/1987 Magourou ..... 439/460
5,131,864 A * 7/1992 Van Zeelst et al. ..... 439/460
5,607,318 A * 3/1997 Wakata et al. ..... 439/274
5,773,758 A * 6/1998 Coutureau et al. ..... 174/65 R
6,109,954 A 8/2000 Lin
6,376,766 B1 4/2002 Bartholomä
6,425,780 B1 * 7/2002 Muhlmichel ..... 439/460

FOREIGN PATENT DOCUMENTS

EP 1 050930 A 11/2000
JP 10321281 12/1998

OTHER PUBLICATIONS

European Search Report.

* cited by examiner

*Primary Examiner*—Tho D. Ta
(74) *Attorney, Agent, or Firm*—Collard & Roe, P.C.

(57) ABSTRACT

A connector includes a contact, a housing receiving the contact, and an engaging member engaged in the housing. The housing has a first receiving portion receiving the contact and a second receiving portion receiving the engaging member. The engaging member has an inserting portion for being inserted with the cable and a cable holding portion for holding the cable with being elastically deformed by the second receiving portion when the engaging member is inserted into the second receiving portion.

8 Claims, 5 Drawing Sheets

CONNECTOR HAVING AN ENGAGING MEMBER FOR HOLDING A CABLE

This application claims priority to prior Japanese patent application JP 2003-313692, the disclosure of which is incorporated herein by reference.

BACKGROUND OF THE INVENTION

This invention relates to a connector having an engaging member engaged with a contact and holding a cable to be connected to the contact.

An existing connector of the type comprises a housing and a cover member attached to the housing to cover an opening portion of the housing. The opening portion is formed at one end of a cavity defined in the housing and serves as an insertion port for insertion of a terminal metal as a contact member.

A cable connected to the terminal metal is bent into a U shape and led out from the inside of the housing through the opening portion. The cable is clamped and held by the cover member and the opening portion of the housing. The cover member is provided with a stopper for inhibiting the terminal metal received in the housing from moving in a removing direction (for example, see Japanese Patent Application Publication (JP-A) No. H10-321281).

The existing connector is disadvantageous in that an external dimension is increased because an outer periphery of the opening portion of the housing is covered with the cover member.

Further, the cover member covering the outer periphery of the housing is often subjected to external force to be damaged and broken.

The cable connected to the terminal metal is held by the cover member and the housing in a bent state. Therefore, a core wire of the cable may be applied with a stress.

Since the cable is led out from a position between the cover member and the opening portion of the housing, a location of the connector is inevitably restricted when the connector is mounted to an electronic apparatus.

SUMMARY OF THE INVENTION

It is an object of this invention to provide a connector which can be reduced in an outer dimension and which is capable of preventing an engaging member from being directly applied with external force.

It is another object of this invention to provide a connector which is capable of reducing a load applied upon a connecting portion of a cable and a contact and minimizing a stress applied upon a core wire of the cable.

It is still another object of this invention to provide a connector capable of minimizing limitation imposed upon a location of the connector and reducing a size of the connector.

It is yet another object of this invention to provide a connector improved in reliability.

According to an aspect of this invention, there is provided a connector for connecting a cable, comprising a contact being conductive and adapted to be connected with the cable, a housing holding the contact; and an engaging member engaged with the housing, the housing comprising a first receiving portion receiving the contact and a second receiving portion receiving the engaging member, the engaging member comprising an inserting portion for being inserted with the cable and a cable holding portion for holding the cable with being elastically deformed by the second receiving portion when the engaging member is inserted into the second receiving portion.

DESCRIPTION OF THE PREFERRED EMBODIMENT

Figure 1:
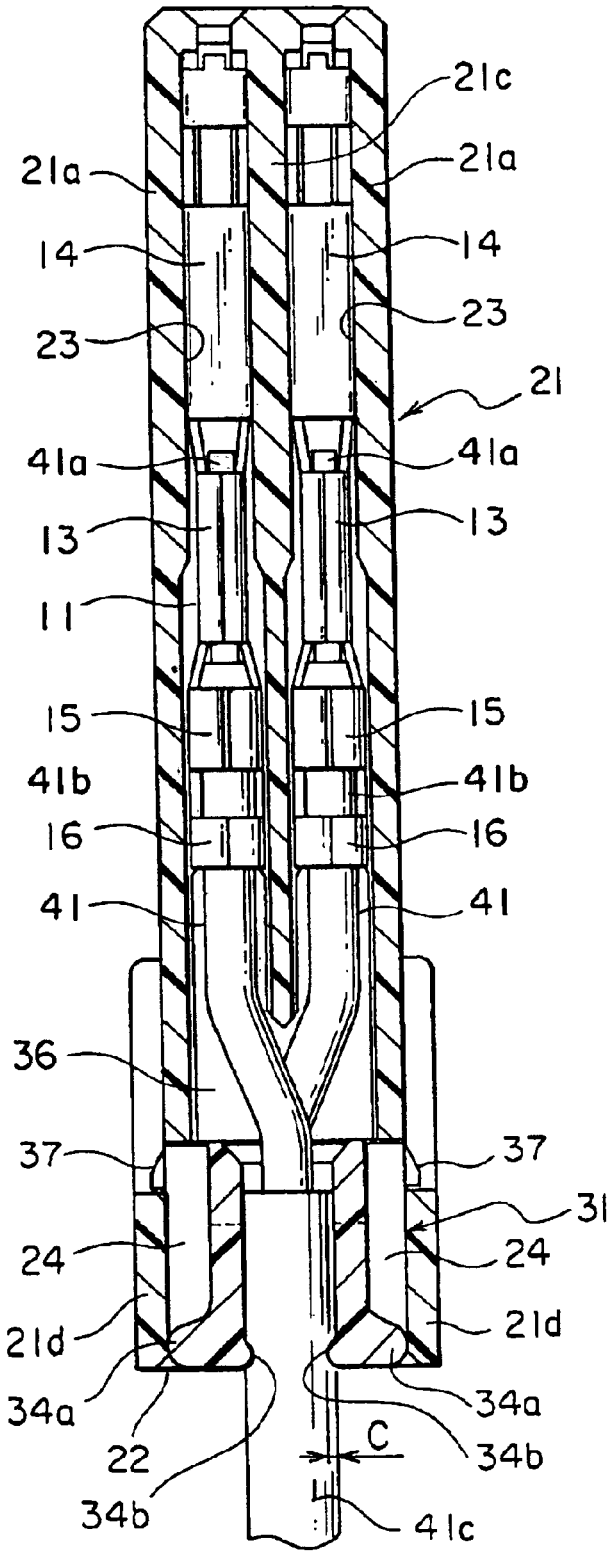
FIG. 1 is a horizontal sectional view of a connector according to an embodiment of this invention in a state where cables are connected to contacts.

Now, description will be made of this invention with reference to the drawing.

Figure 2:
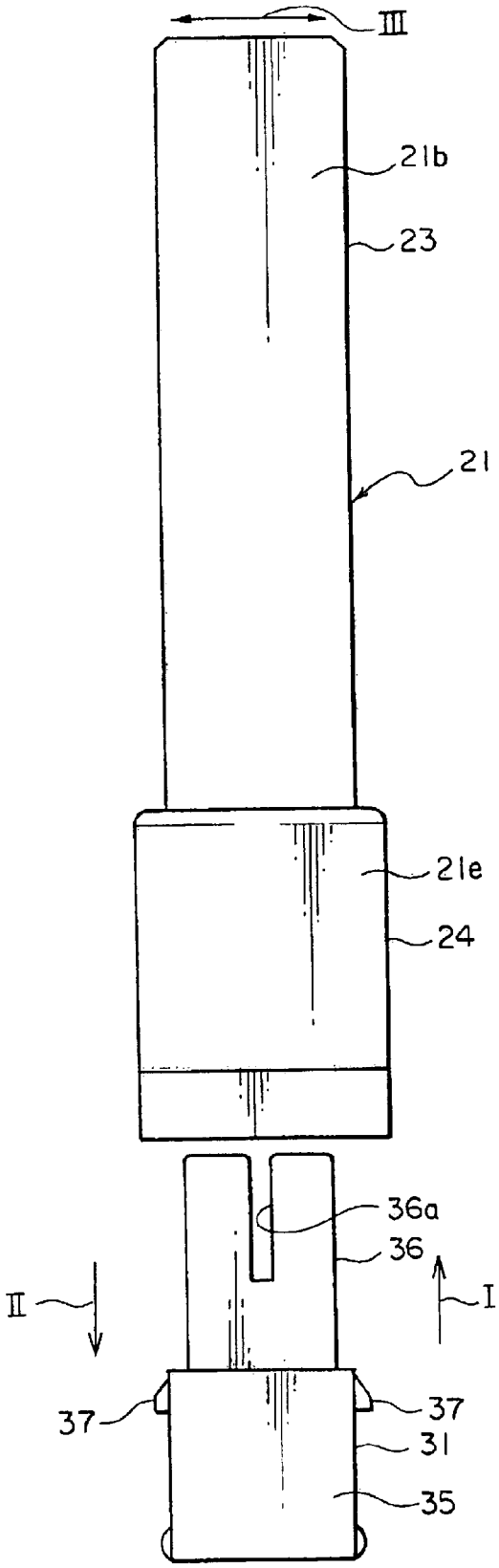
FIG. 2 is an exploded plan view of the connector in FIG. 1 in a state where a housing and an engaging member are separated from each other.

Referring to FIGS. 1 and 2, a connector according to an embodiment of this invention comprises a plurality of conductive contacts 11, a housing 21 having a generally rectangular cylindrical shape and containing the contacts 11, and an engaging member 31 engaged with the housing 21.

In FIG. 1, the engaging member 31 is inserted into the housing 21 in an inserting direction I (see FIG. 2) through an opening portion 22 formed at one end of the housing 21 and is engaged with the housing 21. In FIG. 2, the engaging member 31 is drawn out from the housing 21 through the opening portion 22 in a removing direction II (see FIG. 2) opposite to the inserting direction I.

Referring to FIGS. 1 through 4, the connector will be described in detail.

Each of the contact 11 has a core wire crimping portion 13, a contacting portion 14 extending from one end of the core wire crimping portion 13 towards the inserting direction I, a coating crimping portion 15 extending from the other end of the core wire crimping portion 13 towards the removing direction II, and an engaging portion 16 extending from the coating crimping portion 15 towards the removing direction II.

The core wire crimping portion 13 crimps a core wire 41*a* of a cable 41 and is connected to the core wire 41*a*. The contacting portion 14 is adapted to be connected to a mating contact of a mating connector (not shown). The coating crimping portion 15 crimps a coating portion 41*b* coating the core wire 41*a* of the cable 41.

In this embodiment, a pair of the cables 41 are bundled and covered with a sheath 41*c*. Two pairs of the cables 41, i.e., four cables 41 are received in the connector and connected to the contacts 11, four in number, in one-to-one correspondence although the two cables 41 are illustrated in the figures.

Figure 3:
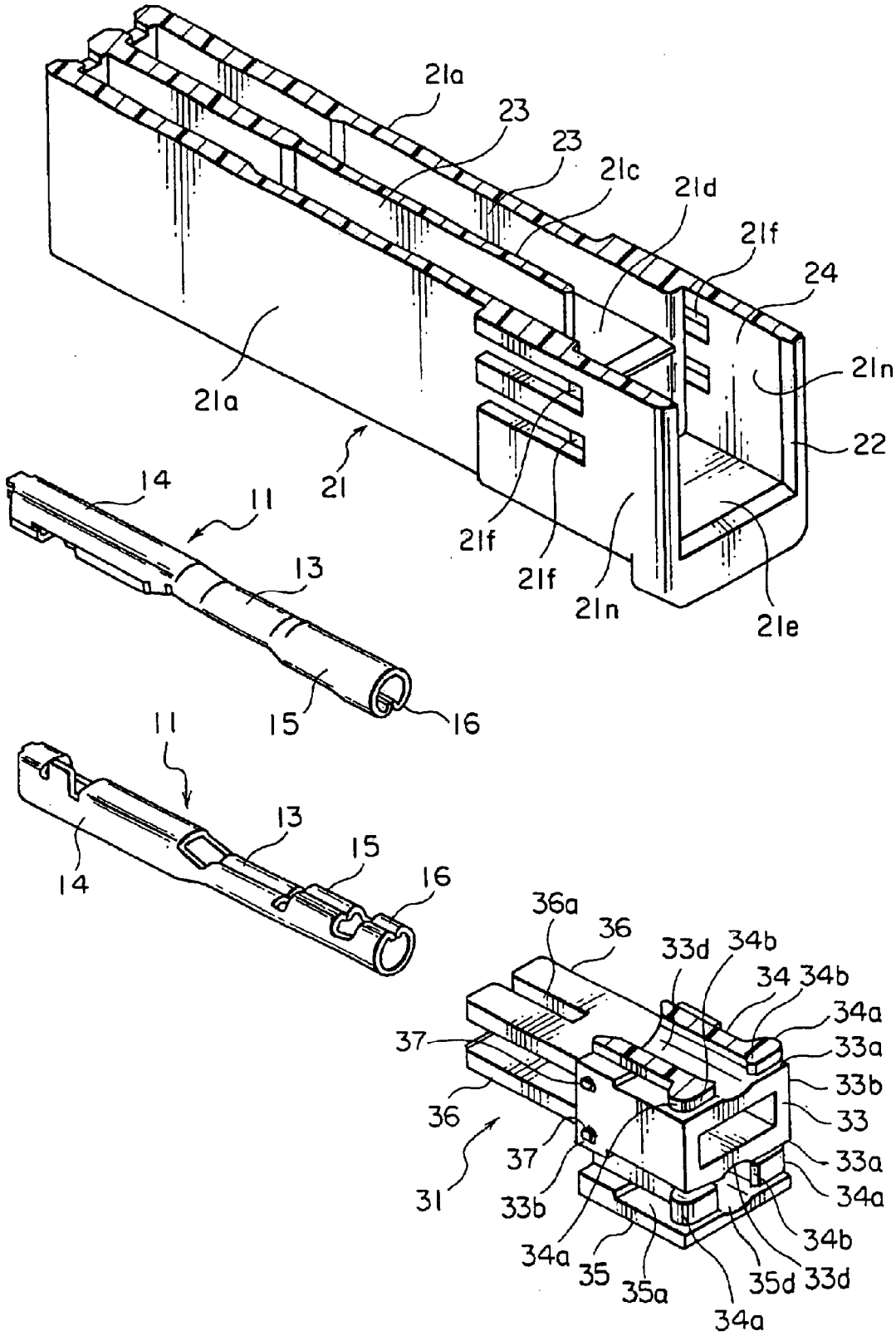
FIG. 3 is an exploded perspective view of the connector in FIG. 1 without the cables.
Figure 4:
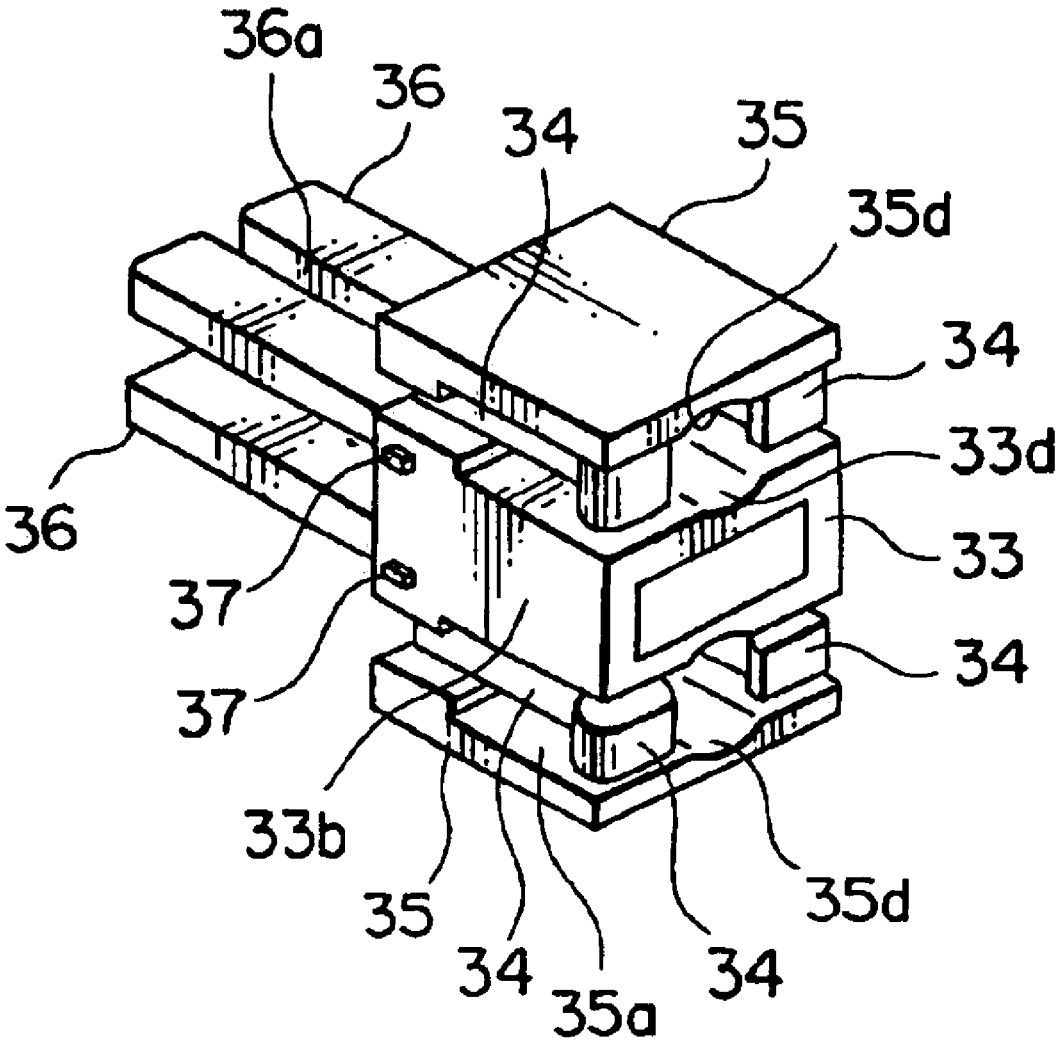
FIG. 4 is a perspective view showing the engaging member in FIG. 1.

Among the four contacts 11, the two contacts 11 are shown in FIG. 3.

The housing 21 has a first receiving portion 23 receiving the contacts 11, and a second receiving portion 24 receiving the engaging member 31.

The first receiving portion 23 has four receiving sections defined in the housing 21 to receive the four contacts 11, respectively. As shown in FIGS. 1 and 3, the first receiving portion 23 is formed by a pair of first side plates 21*a*, a pair of second side plates 21*b*, a first partitioning plate 21*c*, and a second partitioning plate 21*d*.

In FIG. 2, one of the second side plates 21*b* is shown.

The first side plates 21*a* are arranged in parallel to each other and faced to each other. The first side plates 21*a* are connected to the second side plates 21*b*. Thus, the housing 21 is formed by the first and the second side plates 21*a* and 21*b* into the rectangular cylindrical shape.

The first partitioning plate 21*c* is arranged in parallel to the first side plates 21*a* and divides a space between the first side plates 21*a*. The second partitioning plate 21*d* is arranged in parallel to the second side plates 21*b* and divides a space between the second side plates 21*b*.

The first and the second partitioning plates 21*c* and 21*d* intersect each other at right angles. In the housing 21, an internal space defined by the first and the second side plates 21*a* and 21*b* forming the rectangular cylindrical shape is divided by the first and the second partitioning plates 21*c* and 21*d* to define the first receiving portion 23 having the four receiving sections. Thus, the first receiving portion 23 is divided in vertical and horizontal directions as seen from the opening portion 22.

The second receiving portion 24 is formed by a pair of first engaging side plate 21*n* and a pair of second engaging side plates 21*e* continuously extending from the first and the second side plates 21*a* and 21*b* at one end of the housing 21 towards the removing direction II, respectively.

The first engaging side plates 21*n* are arranged in parallel to each other. The second engaging side plates 21*e* are arranged in parallel to each other. Thus, the second receiving portion 24 of the housing 21 is formed by the first and the second engaging side plates 21*n* and 21*e* into a rectangular cylindrical shape.

A distance between the first engaging side plates 21*n* is slightly greater than that between the first side plates 21*a*. A distance between the second engaging side plates 21*e* is slightly greater than that between the second side plates 21*b*.

Each of the first engaging side plates 21*n* is provided with a plurality of window portions 21*f* having a hole-like shape and formed adjacent to one ends of the first and the second partitioning plates 21*c* and 21*d* towards the removing direction II. The window portions 21*f* serve to inhibit the engaging member 31 from moving in the removing direction II when the engaging member 31 is received in the second receiving portion 24. The opening portion 22 of the housing 21 is located at one ends of the first and the second engaging plates 21*n* and 21*e* towards the removing direction II.

The engaging member 31 has a base portion 33 of a generally rectangular cylindrical shape, a plurality of cable holding portions 34 formed on the base portion 33, a pair of guide plate portions 35 formed on the cable holding portions 34, respectively, and a pair of stopper portions 36 extending in the inserting direction I from an end face of the base portion 33 towards the inserting direction I.

The base portion 33 has a pair of first planes 33*a* faced to each other in the vertical direction and a pair of second planes 33*b* connecting the first planes 33*a*.

On each of the first planes 33*a*, a pair of the cable holding portions 34 are formed. Each of the cable holding portion 34 has a long dimension in the inserting and the removing directions I and II. On each of the first planes 33*a* of the base portion 33, the cable holding portions 34 are spaced from each other in a direction III perpendicular to the inserting and the removing directions II.

Each of the cable holding portions 34 has a first end and a second end towards the inserting and the removing directions I and II, respectively. The first end of the cable holding portion 34 is fixed to the first plane 33*a*. The cable holding portion 34 has an extending portion extending from the first end towards the second end and faced to the first plane 33*a* of the base portion 33 with a space kept therefrom. Thus, the cable holding portion 34 is elastically displacable in a plane parallel to the first plane 33*a* except the first end as a fixed end.

The cable holding portions 34 are provided with first protrusions 34*a* formed at the second ends and protruding outward in the direction II. Further, the cable holding portions 34 are provided with second protrusions 34*b* formed at the second ends and protruding inward, i.e., protruding towards each other in the direction III.

The extending portions of the cable holding portions 34 hold the cable 41 in cooperation with the housing 21.

Each of the first planes 33*a* of the base portion 33 is provided with a first insert portion 33*d* as a long groove formed between the cable holding portions 34 and extending in the inserting and the removing directions I and II. Each of the guide plate portions 35 has a confronting surface 35*a* faced to the first plane 33*a*.

The guide plate portions 35 are faced to the first planes 33*a* of the base portion 33 via the cable holding portions 34, respectively. The confronting surface 35*a* of each of the guide plate portions 35 is provided with a groove-like second insert portion 35*d* faced to the first insert portion 33*d*.

A space between the first and the second insert portions 33*d* and 35*d* serves as an inserting portion adapted to insert each pair of the cables 41 covered with the sheath 41*c*. Namely, the first and the second insert portions 33*d* and 35*d* are cooperated with each other to form the inserting portion. In the space between the first and the second insert portions 33*d* and 35*d*, the second protrusions 34*b* of the cable holding portions 34 are protruded.

Each of the stopper portions 36 is provided with a cutout portion 36*a* formed at one end towards the inserting direction I and extending therefrom in the removing direction II. The cutout portions 36*a* serve to receive the first partitioning plate 21*c* when the stopper portions 36 are inserted into the housing 21 above and below the second partitioning plate 21*d*, respectively. Further, the one ends of the stopper portions 36 towards the inserting direction I serve to prevent the contacts 11 received in the housing 21 from moving in the removing direction II.

Each of the second planes 33*b* of the engaging member 31 is provided with a plurality of engaging protrusions 37 to be engaged with the window portions 21*f* in one-to-one correspondence when the engaging member 31 is received in the housing 21.

Hereinafter, description will be made of an assembling operation of the connector with reference to FIGS. 1 through 5. Each of the housing 21 and the engaging member 31 may be formed by molding a resin material.

Figure 5:
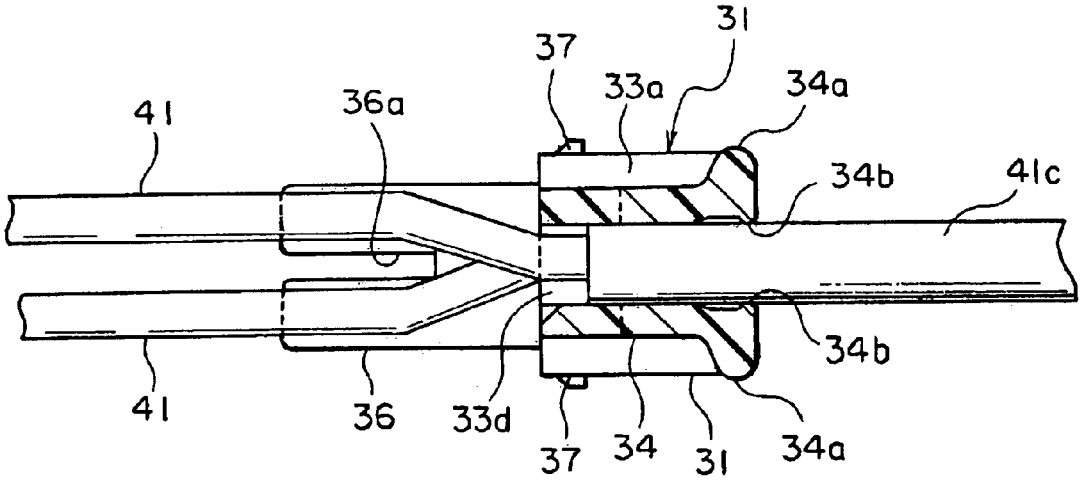
FIG. 5 is a sectional view of the connector in FIG. 1 before the engaging member holding the cables is inserted into the housing.

At first referring to FIG. 5, each pair of the cables 41 bundled by the sheath 41*c* are inserted into the space defined between the first and the second insert portions 33*d* and 35*d* at each of upper and lower portions of the engaging member 31.

In FIG. 5, the two cables 41 are separated from each other. However, when the cables 41 are inserted through the space between the first and the second insert portions 33*d* and 35*d*, the cables 41 are overlapped with each other in a straight line.

When the cables 41 covered with the sheath 41*c* are inserted into the space between the first and the second insert portions 33*d* and 35*d*, the second protrusions 34*b* of the cable holding portions 34 are butted against the sheath 41*c* covering the cables 41. At this time, the cable holding portions 34 are displaced by the sheath 41*c* to be slightly opened outward.

When the cable holding portions 34 are displaced as mentioned above, no stress is applied to the cables 41 by the cable holding portions 34.

Next, the cables 41 are connected to the contacts 11. Thereafter, the contacts 11 are inserted in the inserting direction I into the first receiving portion 23 through the opening portion 22 of the housing 21 with the contacting portions 14 of the contacts 11 directed forward. Thus, the contacts 11 are received in the first receiving portion 23.

Then, the engaging member 31 is guided by the guide plate portions 35 and inserted into the second receiving portion 24 in the inserting direction I. At this time, the first protrusions 34*a* of the cable holding portions 34 are inserted in frictional contact with inner surfaces of the first engaging side plates 21*n* of the second receiving portion 24. In this event, the first protrusions 34*a* are pressed inward so that the cable holding portions 34 are bent and displaced inward.

Therefore, as illustrated in FIG. 1, the sheath 41*c* covering the cables 41 is pressed by the second protruding portions 34*b* forcedly displaced inward (by a moving distance C in FIG. 1). In this state, the cables 41 covered with the sheath 41*c* are tightened and held, via the sheath 41*c*, by the second protrusions 34*b* of the cable holding portions 34.

When the engaging member 31 is inserted into the second receiving portion 24, the stopper portions 36 are inserted in the inserting direction I in parallel to the second partitioning plate 21*d* of the housing 21 above and below the second partitioning plate 21*d*, respectively. At this time, the first partitioning plate 21*c* enters into the cutout portions 36*a* formed in the stopper portions 36 to escape of the first partitioning plate 21*c*.

When the cables 41 are held by the engaging member 31, the engaging protrusions 37 of the engaging member 31 are engaged with the window portions 21*f* of the housing 21. It is therefore possible to prevent the engaging member 31 from being released from the housing 21 in the removing direction II. When the engaging member 31 is received in the second receiving portion 24, the one ends of the stopper portions 36 towards the inserting direction I are brought into contact with end faces of the engaging portions 16 of the contacts 11 to prevent the contacts 11 from moving in the removing direction II.

The cables 41 covered with the sheath 41*c* may be inserted into the space between the first and the second insert portions 33*d* and 35*d* after the contacts 11 are connected to the cables 41. This is because no substantial stress is applied by the cable holding portions 34 upon the cables 41 covered with the sheath 41*c* when the cables 41 are inserted into the space between the first and the second insert portions 33*d* and 35*d*.

As described above in conjunction with the preferred embodiment, the engaging member 31 is received in the second receiving portion 24. Therefore, the connector is reduced in external dimension. In addition, the engaging member 31 is prevented from being directly subjected to external force.

The cables 41 are stretched in the housing 21 in the inserting and the removing directions I and II without being bent in a U shape. Therefore, the stress applied upon the cables 41 is minimized. In addition, limitation imposed upon the location of the connector is minimized.

The cable holding portions 34 tighten and hold the sheath 41*c* covering the cables 41. Therefore, the stress applied upon the core wires 41*a* of the cables 41 is minimized.

Since the engaging member 31 is provided with the cable holding portions 34, it is possible to reduce the load applied upon the connecting portion of the contact 11 and the cable 41 when external force is applied and to improve the reliability.

While this invention has thus far been described in conjunction with the preferred embodiment thereof, it will be readily possible for those skilled in the art to put this invention into practice in various other manners.

What is claimed is:

1. A connector for connecting a cable, comprising:

a contact being conductive and adapted to be connected with said cable;

a housing holding said contact; and an engaging member engaged with said housing, said housing comprising a first receiving portion receiving said contact and a second receiving portion receiving said engaging member;

said engaging member comprising an inserting portion for being inserted with said cable and a cable holding portion for holding said cable with being elastically deformed by said second receiving portion when said engaging member is inserted into said second receiving portion;

said engaging member comprising a base portion and a guide plate opposite to said base portion, said cable holding portion being placed between said base portion and said guide plate.

2. The connector according to claim 1, wherein said cable holding portion has a protrusion protruding towards said inserting portion.

3. The connector according to claim 1, wherein said second receiving portion has a cylindrical shape and comprises an engaging side plate provided with a window portion, said base portion being provided with an engaging protrusion to be engaged with said window portion when said engaging member is inserted into said second receiving portion.

4. The connector according to claim 1, wherein said engaging member has a stopper portion which is engaged with said contact to prevent said contact from being moved from said first receiving portion towards said second receiving portion.

5. The connector according to claim 1, wherein said second receiving portion has a cylindrical shape and comprises an engaging side plate, said cable holding portion being provided with a first protrusion protruding outward to be brought into contact with said engaging side plate when said engaging member is inserted into said second receiving portion.

6. The connector according to claim 5, wherein said cable holding portion is further provided with a second protrusion protruding towards said inserting portion.

7. The connector according to claim 1, wherein said engaging member further comprising an additional cable holding portion cooperated with the first-mentioned cable holding portion for holding said cable with being elastically deformed by said second receiving portion when said engaging member is inserted into said second receiving portion.

8. The connector according to claim 7, wherein said base portion has a first plane and a first insert portion formed on said first plane, said guide plate portion having a confronting surface faced to said first plane and a second insert portion formed on said confronting surface, said first and said second insert portions being cooperated with each other to form said inserting portion.

* * * * *

UNITED STATES PATENT AND TRADEMARK OFFICE

CERTIFICATE OF CORRECTION

PATENT NO. : 6,948,970 B2
DATED : September 27, 2005
INVENTOR(S) : Hayashi, Y. et al.

It is certified that error appears in the above-identified patent and that said Letters Patent is hereby corrected as shown below:

Column 4,
Line 3, after the word "direction" change "II" to -- III --.

Signed and Sealed this

Twenty-seventh Day of December, 2005

JON W. DUDAS
*Director of the United States Patent and Trademark Office*